US005992665A

United States Patent [19]

Deeter

[11] Patent Number: 5,992,665

[45] Date of Patent: Nov. 30, 1999

[54] PORTABLE DISPLAY CASE

[76] Inventor: Richard W. Deeter, 4304 Prestwick Dr., Erie, Pa. 16506

[21] Appl. No.: 09/181,786

[22] Filed: Oct. 28, 1998

[51] Int. Cl.[6] ..... B65D 21/028

[52] U.S. Cl. ..... 220/23.4; 220/23.6; 220/507; 220/23.86; 220/4.27; 220/662; 206/504

[58] Field of Search ..... 220/662, 507, 220/23.4, 23.6, 23.2, 23.83, 23.86, 4.26, 4.27, 377, 480, 826, 759, 768, 526, 553, 554, 555; 206/504

[56] References Cited

U.S. PATENT DOCUMENTS

| | | | |
|---|---|---|---|
| 3,219,400 | 11/1965 | Bergquist | 220/23.6 |
| 3,338,452 | 8/1967 | Oakley et al. | 220/23.4 |
| 3,404,805 | 10/1968 | Stockman et al. | 220/23.6 |
| 4,589,546 | 5/1986 | Sunderland | 220/507 |
| 5,431,294 | 7/1995 | Stottmann et al. | 220/23.4 |
| 5,878,881 | 3/1999 | Hunt | 206/361 |
| 5,890,613 | 4/1999 | Williams | 220/23.4 |

FOREIGN PATENT DOCUMENTS

| | | | |
|---|---|---|---|
| 1044124 | 9/1996 | United Kingdom | 220/662 |

*Primary Examiner*—Stephen Castellano
*Attorney, Agent, or Firm*—Richard K. Thomson

[57] ABSTRACT

A see-through display case has a plurality of compartments for storing, displaying and transporting a plurality of collectibles. Each case has an open front face which is closed by a clear plastic cover hinged to the front edge of the top surface. A case may be attached to vertically adjacent cases by means of a pair of tongue and groove interlocks integral to both the top and bottom surfaces and to laterally adjacent cases by a tongue on one case and a groove on the adjacent case to form a unit of interconnected cases. Each of the interlocks is activated by sliding a first of the adjacent cases front to back relative to the other adjacent case. An array of cases as large as two by two can be transported using an attachable handle which can be connected to the uppermost, centrally positioned pair of tongue and groove interlocks.

20 Claims, 3 Drawing Sheets

PORTABLE DISPLAY CASE

BACKGROUND AND SUMMARY OF THE INVENTION

It has become all the rage to collect a variety of items including model cars, dolls and stuffed animals. Of particular interest of late, are the BEANIE BABIES stuffed toys manufactured and sold by Ty Inc. Various paperboard carriers are being manufactured as display devices.

The present invention provides a competitively priced display case made of durable, transparent or opaque plastic to which an attachable handle can be affixed and the display case, with its collectible treasures, transported. Each display case has a plurality of compartments, in the preferred embodiment, four equal volume areas, and is provided with a hinged cover for its front face. The cover is clear plastic with four bubble windows which permit viewing of the compartments' contents. The cover is attached to a front edge of the top so that the cover can pivot up to provide access to the compartments or downwardly to snap in place to provide securement of the compartments and their contents for possible transport. The pivoting of the front cover can be accomplished without contacting, or interference from, an adjacent interlocked case.

Each case is configured with first interlocking means on the top and a second interlocking means on the bottom to enable vertically adjacent cases to be interconnected. Similarly, first interlocking means is provided on one end and second interlocking means is provided on the opposite end so that laterally adjacent cases can be interconnected. The means for interlocking vertically adjacent cases is preferably one tongue and one groove on the top and one groove and one tongue on the bottom to engage a vertically adjacent case. The vertically adjacent cases are interlocked by aligning a back of one of the vertically adjacent cases with the front of the case beneath it and sliding it from front toward the back of the lower case to cause its groove and tongue to slide into locking engagement with the tongue and groove of the other case. The means for interconnecting a case to a laterally adjacent case comprises a tongue on one end and a groove on the other. The pair of laterally adjacent cases are interlocked by positioning a tongue on one side of one case in front of the groove on an adjacent case (or visa versa) and sliding the case rearwardly so the tongue slides into the groove. The attachable handle can be secured to the top of an individual display case by sliding its groove and tongue onto the tongue and groove of that case, or the handle may be turned end for end and secured to the tops of two adjacent cases which have been interconnected by sliding the handle onto a groove of one case and a tongue of a laterally adjacent interconnected case, to provide a transportable unit comprised of as many of four interlocked cases.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
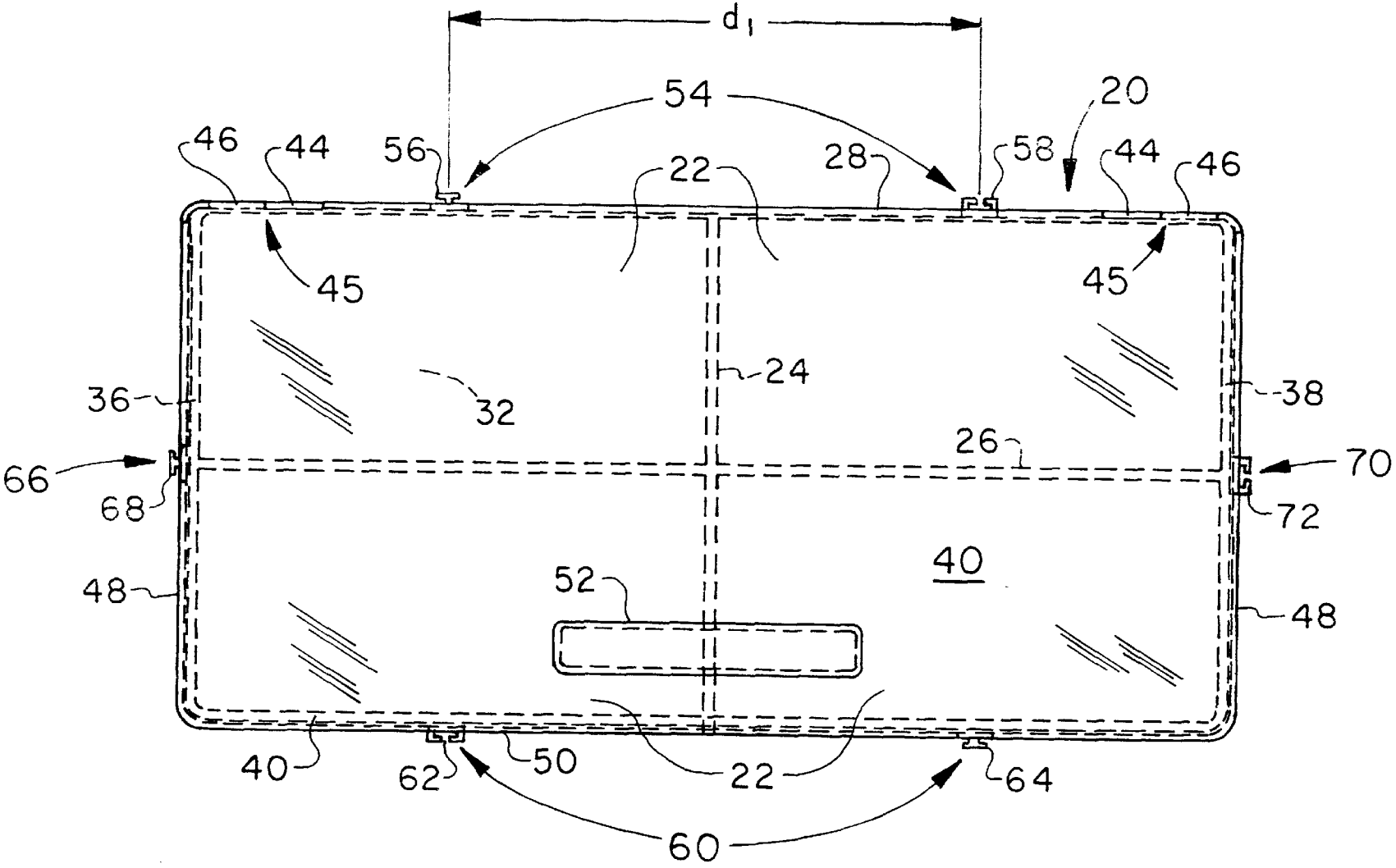
FIG. 1 is a front view of a first embodiment of the portable display case of the present invention.
Figure 2:
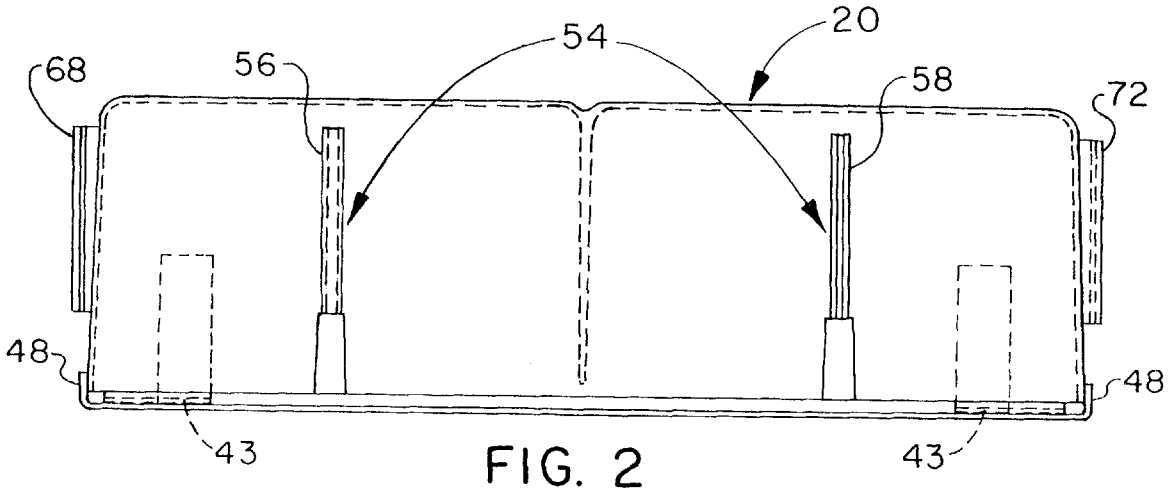
FIG. 2 is a top view of the first embodiment.
Figure 3:
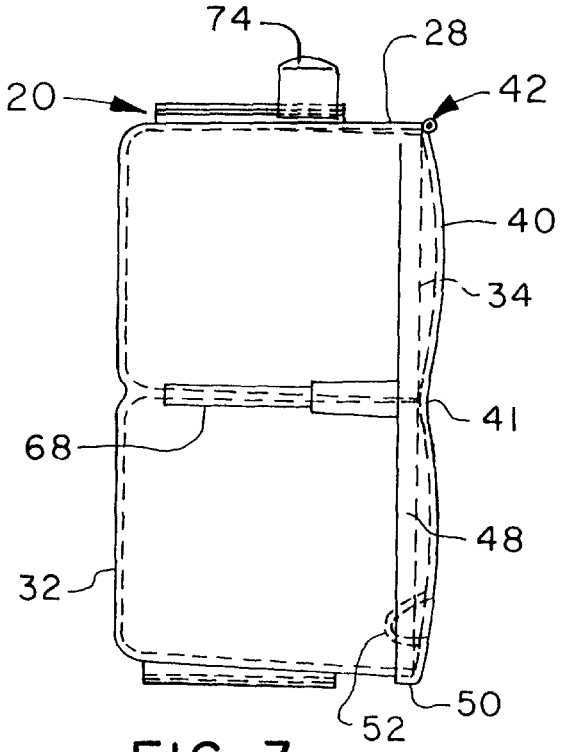
FIG. 3 is an end view of the first embodiment.

A first preferred embodiment of the display case of the present invention is shown in FIGS. 1–3 generally at 20. Display case 20, which is made of a durable see-through (transparent) plastic which may be colorless or tinted with a solid pigment, has a plurality of compartments 22 which permit storage, display and transport of a plurality of collectibles. Suitable materials for display case 20 include styrene, high-impact styrene and k-resins, with the high-impact styrene being preferred. In this the preferred embodiment, the compartments are formed by one vertical wall 24 and one horizontal wall 26 dissecting case 20 into four equal volumes. Case 20 comprises a see-through container which has a top 28, bottom 30, back wall 32, open front 34, first side 36, and second side 38. A cover 40 made of colorless plastic has four viewing windows and is hinged to the front edge 42 of top 28, pin 43 extending through hinge 45 defined by hinge cylinder 44 integral with edge 42 and hinge cylinder 46 integral with cover 40. Cover 40 forms two rows of "bubble windows" into the individual compartments with a central region 41 contacting horizontal wall 26 (see FIG. 3). Lateral flanges 48 overlap and frictionally engage first and second sides 36 and 38, while leading edge flange 50 overlaps and frictionally engages bottom 30. An indentation or recess 52 is formed in the face of cover 40 providing a handle for engaging and opening cover 40. Frictional engagement between flanges 48 and 50 and lateral and bottom sides 36, 38 and 30 hold the cover 40 closed until recess 52 is manually engaged and cover 40 pivoted upwardly about hinge 45 to permit access to compartments 22.

Top 28 is provided with first vertical interlocking means 54 and bottom 30 is provided with second vertical interlocking means 60 for permitting two vertically adjacent cases 20 to be assembled into a unit. First interlocking means 54 preferably is comprised of a T-shaped rail or tongue 56 and a T-shaped groove 58 spaced from tongue 56 by a distance $d_1$. Second interlocking means 60 comprises a corresponding T-shaped groove 62 and tongue 64 which can engage a first interlocking means 54 of a vertically adjacent case **20*b* (see FIG. 4). The upper case 20*a* is slid rearwardly with respect to lower case 20*b* with the rear portion of groove 62*a* engaging the front portion of tongue 56*b* and the rear portion of tongue 64*a* engaging the front portion of groove 58*b*. This will cause the second interlocking means 60 of the upper case 20*a* to engage first interlocking means 54 of the lower case 20*b* forming them into a unit. There is a slight taper on case 20, front to back (see FIG. 3) and interlocking means 54 and 60 are set back from front face 34 a sufficient amount that interlocking means 54 and 60 do not appreciably increase the height of cases 20** nor interfere with the cases' sitting on planar surfaces.

First lateral interlocking means 66 comprises a T-shaped tongue 68 attached to first side 36 and second lateral interlocking means 70 comprises a T-shaped groove 72 attached to second side 38. Laterally adjacent cases **20*a* and 20*c* can be interconnected by sliding case 20*a* rearwardly relative to case 20*c* with the rear portion of groove 72*a* engaging the front portion of tongue 68*c*. Cases 20*a* and 20*c*** will now be formed into a display case unit.

Figure 4:
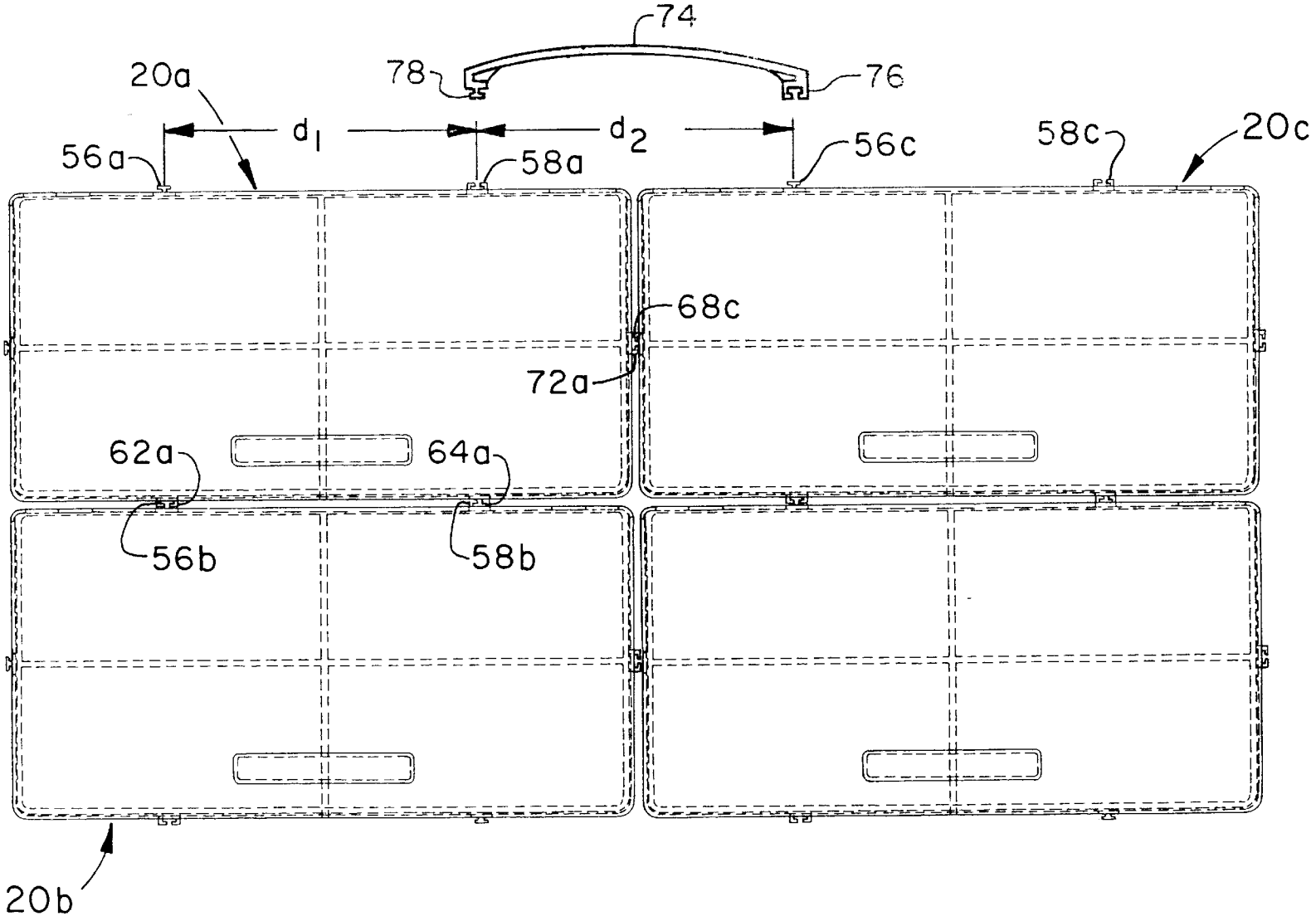
FIG. 4 is a front view of four interconnected display cases of the first embodiment.

Handle 74 is equipped with a groove 76 and a tongue 78 that can engage the interlocking means 54 of a single case by the same rearward sliding motion that interconnects adjacent cases 20*a* and 20*b* or 20*c*. Alternatively, as depicted in FIG. 4, handle 74 can be turned end-for-end, and tongue 78 and groove 76 used to engage groove 58*a* and tongue 56*c* on cases 20*a* and 20*c* respectively. Note, groove 58*a* and tongue 56*c* is spaced by a distance $d_2$ which is equal to $d_1$, permitting this alternative usage of handle 74. Wedge shaped stops (not shown) are formed on tongue 56 and in groove 58 to engage handle 74 and maintain it in its proper position preventing undesired removal. Corresponding groove 62 and tongue 64 are dimensioned to enable them to bypass the handle engaging stops. As shown in FIG. 4, four cases 20 can be interconnected to form a transportable unit using handle 74. While larger arrays are certainly possible, a unit of four cases, representing 16 collectibles, is the largest that can reasonably be transported using handle 74.

It will be appreciated that the present invention provides a transportable display case 20 that is capable of interlocking horizontally and vertically to adjacent cases to form a unit. An array of as many of 4 interlocked cases can be transported using a detachable handle 74. The interlocked display cases can be attractively arrayed on a shelf or table and used to arrange a variety of collectibles in an orderly configuration.

While it will be appreciated that the portable display case of the present invention is particularly well suited for storing, displaying and transporting BEANIE BABIES stuffed toys, these particular collectibles are merely exemplary of the types of items which can be stored, displayed and transported by the portable display case of the present invention.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A display case for storing, displaying and transporting collectibles comprising:

a) a see-through plastic container having a plurality of compartments, said container having surfaces including an open front, a back, a top, a bottom, a first side and a second side;

b) a pivotable cover for said open front;

c) first vertical interlocking means on said top;

d) second vertical interlocking means on said bottom of said display case engageable with said first vertical interlocking means on said top of a vertically adjacent display case to interconnect said adjacent display cases to form a unit;

e) an attachable handle connectable to said top of an uppermost display case;

whereby said handle can be utilized to transport a unit of said display cases with the collectibles contained therein.

2. The display case of claim 1 wherein said see-through plastic is selected from the group consisting of colorless and tinted.

3. The display case of claim 1 wherein said pivotable cover is hinged to a forward edge portion of said top.

4. The display case of claim 3 wherein said pivotable cover has a hand-grippable indentation near its lower edge.

5. The display case of claim 3 wherein said pivotable cover has an rearwardly extending flange extending from a distal edge of said cover which overlaps and frictionally engages a forward edge of said bottom of said display case and a rearwardly extending flange protruding from each of first and second lateral edges of said cover engaging said first and second sides of said display case, said flanges securing said cover in its closed position.

6. The display case of claim 1 further comprising third interlocking means on said first side and fourth interlocking means on said second side engageable with said third interlocking means on said first side of a laterally adjacent display case to interconnect said adjacent display cases to form a unit.

7. The display case of claim 6 wherein at least one of said first and second interlocking means and one of said and fourth interlocking means comprises a T-shaped groove extending axially along its respective surface and a second one of said first and second interlocking means and one of said third and fourth interlocking means comprises a T-shaped tongue extending axially along its respective surface.

8. The display case of claim 7 wherein said first interlocking means comprises a T-shaped tongue and a T-shaped groove spaced laterally therefrom by a distance $d_1$ on said top and said second interlocking means comprises a corresponding T-shaped groove and a corresponding T-shaped tongue spaced laterally therefrom by a distance $d_1$ on said bottom.

9. The display case of claim 8 wherein when said two display cases are laterally interconnected, a T-shaped groove of a first interconnected case will be spaced from a T-shaped tongue of an adjacent interconnected case by a distance $d_2$, wherein $d_2$ is equal to $d_1$.

10. The display case of claim 9 wherein said attachable handle can be connected to said T-shaped groove and said T-shaped tongue on said laterally adjacent interconnected display cases to permit transporting of said display case unit.

11. The display case of claim 1 wherein said first interlocking means on said top of said display case comprises one T-shaped tongue and one T-shaped groove extending parallel thereto and spaced therefrom by a distance $d_1$ and said second interlocking means on said bottom comprises a T-shaped groove and a T-shaped tongue spaced by a distance $d_1$ which can be axially slid onto the corresponding tongue and groove of a vertically adjacent display case positioned beneath said respective display case.

12. The display case of claim 1 wherein said plurality of compartments comprises two lowermost compartments and two uppermost compartments situated thereabove.

13. The display case of claim 12 wherein each of said plurality of compartments are generally rectangular in both lateral cross section and in axial cross section.

14. The display case of claim 13 wherein said each of said plurality of compartments has equal volume.

15. A display case for storing, displaying and transporting collectibles comprising:

a) a see-through plastic container having a plurality of compartments, said containers having surfaces including an open front, a back, a top, a bottom, a first side and a second side;

b) a pivotable cover for said open front;

c) first horizontal interlocking means on said first side;

d) second horizontal interlocking means on said second side engageable with said first horizontal interlocking means on said first side of a laterally adjacent display case to interconnect said adjacent display cases to form a unit;

e) an attachable handle connectable to said top of at least one uppermost display case;

whereby said handle can be utilized to transport a unit of said display cases with the collectibles contained therein.

16. The display case of claim 15 further comprising third interlocking means on said top and fourth interlocking means on said bottom engageable with said third interlocking means on said top of a vertically adjacent display case to interconnect said adjacent display cases to form a unit.

17. The display case of claim 16 wherein said attachable handle is connectable to third interlocking means on each of the tops of the two uppermost laterally interconnected display cases to transport a unit of said display cases.

18. A display case for storing, displaying and transporting collectibles comprising:

a) a see-through plastic container having a plurality of compartments, said container having surfaces including an open front, a back, a top, a bottom, a first side and a second side;

b) a see-through cover hingeably attached to a front edge of said top to permit access to each of said plurality of compartments;

c) means to interconnect said display case with an adjacent display case to form a unit, d) an attachable handle connectable to a top portion of said display case unit to permit said unit with its stored collectibles to be transported;

whereby said hingeably attached cover can be pivoted upwardly to open said front portion of said display case without interference from said adjacent interconnected display case.

19. The display case of claim 18 wherein said means to interconnect said display case to an adjacent display case comprises means to interconnect said display case to a vertically adjacent display case.

20. The display case of claim 18 wherein said means to interconnect said display case to an adjacent display case comprises means to interconnect said display case to a horizontally adjacent display case.

* * * * *